US006260892B1

(12) United States Patent
Chang

(10) Patent No.: US 6,260,892 B1
(45) Date of Patent: Jul. 17, 2001

(54) ELECTROMAGNETIC LOCK HAVING GUIDING MECHANISM

(76) Inventor: Zhi Chung Chang, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 0 days.

(21) Appl. No.: 09/373,414

(22) Filed: Aug. 11, 1999

Related U.S. Application Data

(63) Continuation-in-part of application No. 09/072,572, filed on May 4, 1998, now abandoned.

(51) Int. Cl.[7] ..... E05C 17/56
(52) U.S. Cl. ..... 292/251.5; 292/341.16
(58) Field of Search ..... 292/251.5, 144, 292/341.16, DIG. 55

(56) References Cited

U.S. PATENT DOCUMENTS 4,487,439 * 12/1984 McFadden ..... 292/251.5
4,957,316 * 9/1990 Frolov ..... 292/251.5
5,016,929 5/1991 Frolov ..... 292/251.5
5,184,856 2/1993 Waltz ..... 292/251.5
6,007,119 * 12/1999 Roth ..... 292/251.5

* cited by examiner

*Primary Examiner*—Gary W. Estremsky

(57) ABSTRACT

An electromagnetic door lock includes an electromagnet secured to a frame and having one or more projections, and a housing secured to a door panel for slidably receiving an armature plate. The armature plate includes one or more orifices for receiving the projections of the electromagnet and for preventing a shearing movement between the electromagnet and the armature plate when the armature plate is attracted toward the electromagnet. A guiding mechanism may be used for guiding the projection of the electromagnet to be aligned with the orifice of the armature plate.

8 Claims, 4 Drawing Sheets

ELECTROMAGNETIC LOCK HAVING GUIDING MECHANISM

The present invention is a continuation-in-part of U.S. patent application Ser. No. 09/072,572, filed on May 4, 1998, now abandoned by not responding to the Official Action dated May 25, 1999.

BACKGROUND OF THE INVENTION

1. Field of the Invention

The present invention relates to a door lock, and more particularly to an electromagnetic door lock having a guiding mechanism.

2. Description of the Prior Art

Two typical electromagnetic door locks are disclosed in U.S. Pat. No. 5,016,929 to Frolov and U.S. Pat. No. 5,184,856 to Waltz and comprise an armature plate to be attracted by an electromagnet and to lock the door panels to the door frames. The armature plate normally is to be attracted to the electromagnet for securing the door panel to the door frame. However, after use, the hinge device for pivotally securing the door panel to the door frame may become loose, or the door panel may be tilted relative to the door frame, such that the armature plate may not be precisely aligned with and engaged into the electromagnet recess and such that the door panel may not be locked by the electromagnetic door lock. The electromagnetic door lock may thus be discarded and be replaced with a new one. For saving money, some people may adjust the armature plate relative to the electromagnet, and vice versa, for allowing the armature plate to be attracted to the electromagnet.

The present invention has arisen to mitigate and/or obviate the afore-described disadvantages of the conventional electromagnetic door locks.

SUMMARY OF THE INVENTION

The primary objective of the present invention is to provide an electromagnetic door lock including a guiding mechanism for guiding the armature plate to be aligned with the electromagnet and to be precisely attracted by the electromagnet.

In accordance with one aspect of the invention, there is provided an electromagnetic door lock comprising an electromagnet for securing to a frame, the electromagnet including at least one projection extended therefrom, a housing for securing to a door panel, an armature plate slidably received in the housing, the armature plate including at least one orifice formed therein for receiving the projection of the electromagnet and for preventing a shearing movement between the electromagnet and the armature plate when the armature plate is attracted toward the electromagnet, and means for guiding the projection of the electromagnet to be aligned with the orifice of the armature plate.

The guiding means includes at least one groove formed in the armature plate and communicating with the orifice of the armature plate for guiding the projection of the electromagnet to be aligned with the orifice of the armature plate. The orifice of the armature plate includes a depth greater than that of the groove of the armature plate for solidly receiving the projection of the electromagnet. The guiding means further includes at least one tapered surface formed in the armature plate and communicating with the groove of the armature plate for guiding the projection of the electromagnet to engage with the groove of the armature plate.

A device is further provided for guiding the armature to slide in the housing and includes at least one guide secured to the housing and having a head, the armature includes at least one opening formed therein for slidably receiving the head of the guide and for guiding the armature plate to slide in the housing. The armature plate includes an annular flange extended inward of the opening of the armature plate for engaging with the guide and for preventing the guide from being disengaged from the armature plate. A board is secured to the armature plate for engaging with the guide and for preventing the guide from being disengaged from the armature plate. A spring is further provided for biasing the armature plate toward the electromagnet.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
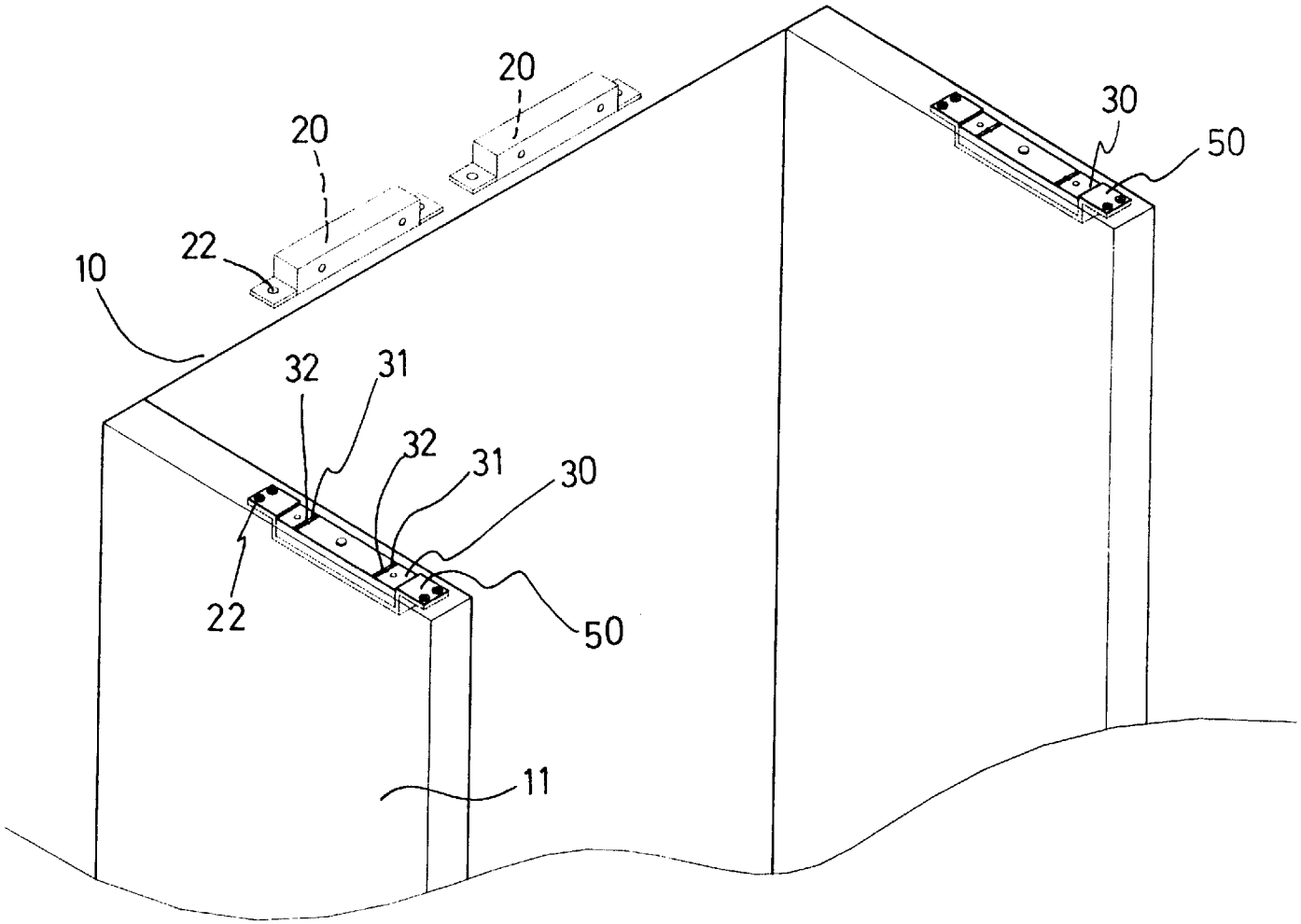
FIG. 1 is a perspective view illustrating an application of an electromagnetic door lock in accordance with the present invention.
Figure 2:
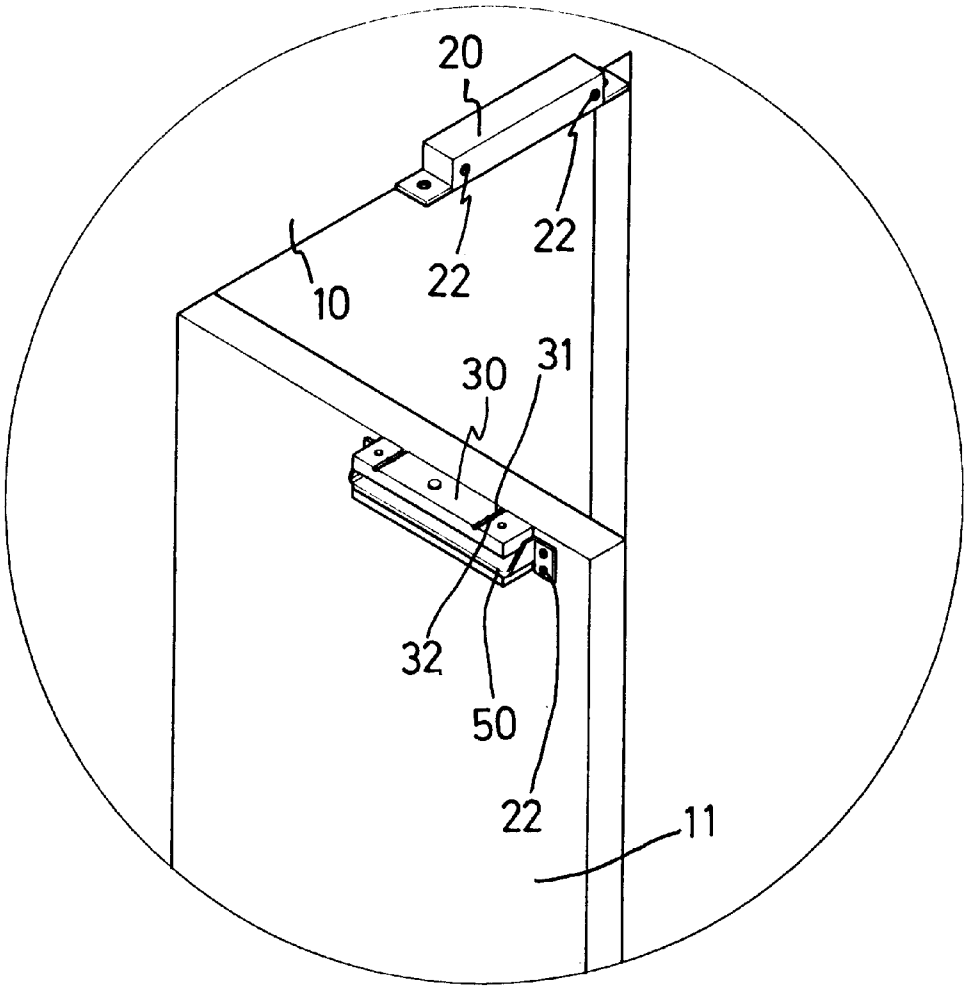
FIG. 2 is a perspective view similar to FIG. 1, illustrating the other application of an electromagnetic door lock.

Referring to the drawings, and initially to FIGS. 1 and 2, an electromagnetic door lock in accordance with the present invention comprises an electromagnet 20 secured to a frame, particularly a door frame 10 by fasteners 22, and an armature plate 30 slidably and resiliently supported in a housing 50 which is secured to a panel, particularly a door panel 11 with fasteners 22. The armature plate 30 is preferably made of metal or made of magnetizable materials and is to be attracted to the electromagnet 20 for securing the door panel 11 to the door frame 10. The electromagnet 20 and the armature plate 30 and the housing 50 may be engaged into the door frame 10 and the door panel 11 respectively (FIG. 1); or may be secured to the side portions of the door frame 10 and the door panel 11 respectively (FIG. 2); and are arranged for allowing the armature plate 30 to be attracted to the electromagnet 20 for securing the door panel 11 to the door frame 10. The electromagnet 20 may also be secured to the door panel 11, and the armature plate 30 and the housing 50 may also be secured to the door frame 10 if required. The electromagnet 20 is shown to be disposed above the armature plate 30; but may be disposed beside or below the armature plate 30 if required.

Figure 3:
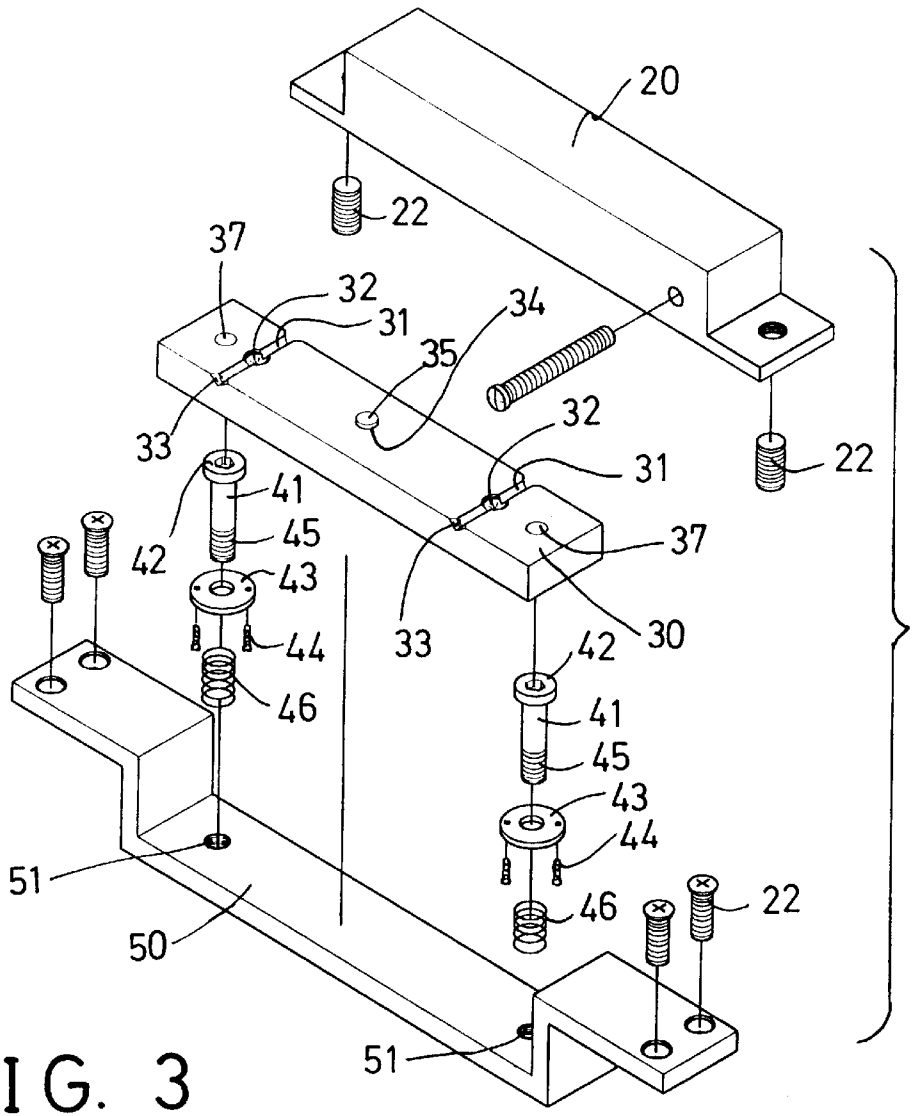
FIG. 3 is an exploded view of the electromagnetic door lock.
Figure 4:
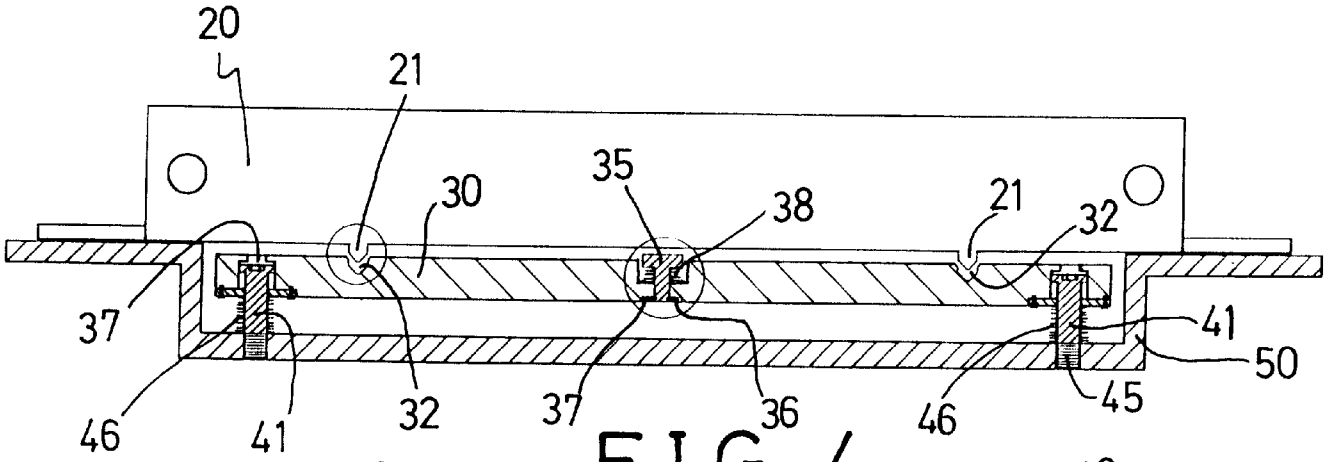
FIG. 4 is a cross sectional view of the electromagnetic door lock.

Referring next to FIGS. 3 and 4, the electromagnet 20 includes one or more projections 21 (FIGS. 4, 5) extended therefrom, particularly extended downward therefrom. The armature plate 30 includes one or more grooves 31 and one or more orifices 32 formed in the upper surface thereof. The orifices 32 are provided for receiving the respective projections 21 of the electromagnet 20 (FIG. 5) and for preventing a shearing movement between the electromagnet 20 and the armature plate 30. The orifices 32 of the armature plate 30 are preferably formed in the middle portion of the respective grooves 31 of the armature plate 30 and include a depth greater than that of the grooves 31 for solidly receiving the respective projections 21 of the electromagnet 20 and for preventing a shearing movement between the electromagnet 20 and the armature plate 30 when the armature plate 30 is attracted to the electromagnet 20. The grooves 31 of the armature plate 30 are provided for guiding the respective projections 21 to be aligned with the orifices 32 when the door panel 11 is rotated toward the door frame 10. The armature plate 30 further includes one or more tapered guiding surfaces 33 formed in the edge portion thereof and/or communicating with the respective grooves 31 and for further guiding the respective projections 21 to be aligned with the orifices 32 when the door panel 11 is tilted relative to the door frame 10 and when the tilted door panel 11 is rotated toward the door frame 10.

The armature plate 30 includes one or more openings 39 (FIGS. 4–6) formed in the lower portion thereof and includes one or more annular flanges 40 extended radially inward from the upper portion of the openings 39 for defining an aperture 37 which has a size smaller than that of the openings 39 of the armature plate 30. One or more guides 41 each includes a head 42 formed on top thereof and slidably received in the openings 39 of the armature plate 30 and each includes an outer thread 45 formed in the bottom portion thereof and threaded to the screw holes 51 of the housing 50. One or more boards 43 are secured to the bottom of the armature plate 30 by fasteners 44 for partially enclosing the opening 39 of the armature plate 30 and for slidably receiving the guides 41 and for engaging with the heads 42 of the guides 41 and for slidably retaining the heads 42 of the guides 41 in the openings 39 of the armature plate 30 and for preventing the armature 30 from being disengaged from the housing 50. One or more springs 46 are engaged on the respective guides 41 and engaged between the armature plate 30 and the housing 50 for biasing the armature plate 30 toward the electromagnet 20 and for allowing the armature plate 30 to be moved toward the housing 50 against the springs 46.

The armature plate 30 further includes one or more cavities 34 formed therein for slidably receiving a pusher 35. A retaining ring 36 is secured to the lower end of the pusher 35 and slidably received in a depression 37 of the armature plate 30. A spring 38 is engaged between the pusher 35 and the armature plate 30 for biasing the pusher 35 slightly upward beyond the armature plate 30 to engage with the electromagnet 20. The biasing force of the spring 38 is selected for allowing the armature plate 30 to be attracted to the electromagnet 20 by the electromagnet 20 and for biasing the armature plate 30 downward away from the electromagnet 20 when the electromagnet 20 is not energized. It is to be noted that, without the spring 38, the armature plate 30 may also be dropped downward away from the electromagnet 20 by the weight of the armature plate 30 when the electromagnet 20 is not energized.

Figure 5:
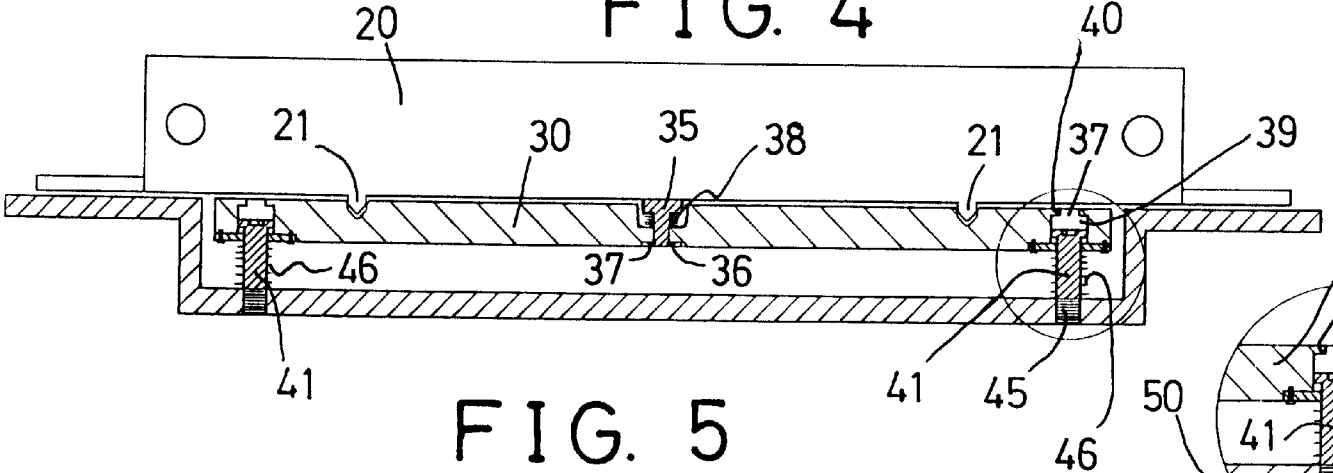
FIG. 5 is a cross sectional view similar to FIG. 4, illustrating the operation of the electromagnetic door lock.
Figure 6:
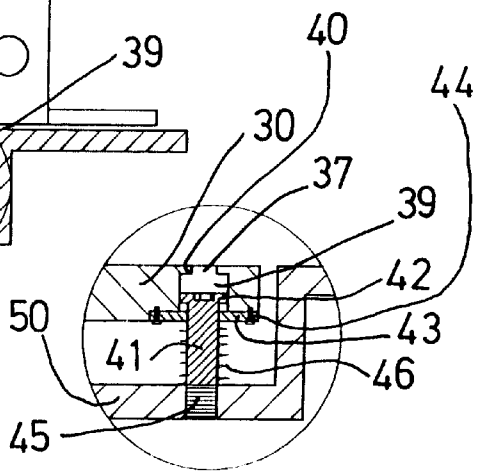
FIG. 6 is an enlarged partial cross sectional view illustrating the operation of the electromagnetic door lock.

In operation, as shown in FIGS. 1 and 2, when the door panel 11 is rotated toward the door frame 10, the groove(s) 31 and/or the tapered surface(s) 33 of the armature plate 30 may receive and guide the projection(s) 21 of the electromagnet 20 to be aligned with the orifices 32 of the armature plate 30 (FIG. 4). As shown in FIG. 5, when the armature plate 30 is attracted to the electromagnet 20 by the electromagnet 20, the engagement of the projections 21 in the orifices 32 of the armature plate 30 may prevent the shearing movement between the electromagnet 20 and the armature plate 30.

The electromagnet 20 may includes a recess formed therein for receiving the armature plate 30 and for solidly securing the armature plate 30 to the electromagnet 20 and for further preventing the shearing movement between the armature plate 30 and the electromagnet 20.

Accordingly, the electromagnetic door lock in accordance with the present invention includes a guiding mechanism for guiding the armature plate to be aligned with the electromagnet and to be precisely attracted by the electromagnet.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electromagnetic door lock comprising:

an electromagnet for securing to a frame, said electromagnet including at least one projection extended therefrom, a housing for securing to a door panel, an armature plate slidably received in said housing, said armature plate including at least one orifice formed therein for receiving said at least one projection of said electromagnet and for preventing a shearing movement between said electromagnet and said armature plate when said armature plate is attracted toward said electromagnet, and a first guiding means for guiding said at least one projection of said electromagnet to be aligned with said at least one orifice of said armature plates, wherein said first guiding means includes at least one groove formed in said armature plate and communicating with said at least one orifice of said armature plate for guiding said at least one projection of said electromagnet to be aligned with said at least one orifice of said armature plate.

2. The electromagnetic door lock according to claim 1, wherein said at least one orifice of said armature plate includes a depth greater than that of said at least one groove of said armature plate for solidly receiving said at least one projection of said electromagnet.

3. The electromagnetic door lock according to claim 1, wherein said guiding means further includes at least one tapered surface formed in said armature plate and communicating with said at least one groove of said armature plate for guiding said at least one projection of said electromagnet to engage with said at least one groove of said armature plate.

4. The electromagnetic door lock according to claim 1 further comprising a second guiding means for guiding said armature to slide in said housing.

5. The electromagnetic door lock according to claim 4, wherein said second guiding means includes at least one guide secured to said housing and having a head, said armature includes at least one opening formed therein for slidably receiving said head of said at least one guide and for guiding said armature plate to slide in said housing.

6. The electromagnetic door lock according to claim 5, wherein said armature plate includes an annular flange extended inward of said at least one opening of said armature plate for engaging with said at least one guide and for preventing said at least one guide from being disengaged from said armature plate.

7. The electromagnetic door lock according to claim 1 further comprising means for biasing said armature plate toward said electromagnet.

8. An electromagnetic door lock comprising:

an electromagnet for securing to a frame, said electromagnet including at least one projection extended therefrom, a housing for securing to a door panel, an armature plate slidably received in said housing, said armature plate including at least one orifice formed therein for receiving said at least one projection of said electromagnet and for preventing a shearing movement between said electromagnet and said armature plate when said armature plate is attracted toward said electromagnet, a first guiding means for engaging and aligning said at least one projection on a specified path towards said at least one orifice prior to said at least one projection making contact with said at least one orifice, a second guiding means for guiding said armature to slide in said housing, said second means including at least one guide secured to said housing and having a head, said armature plate including at least one opening formed therein for slidably receiving said head of said at least one guide and for guiding said armature plate to slide in said housing, and a board secured to said armature plate for engaging with said at least one guide and for preventing said at least one guide from being disengaged from said armature plate.

* * * * *